US005630722A

United States Patent [19]

Mochizuki et al.

[11] Patent Number: 5,630,722

[45] Date of Patent: May 20, 1997

[54] IGNITION CABLE CONNECTION FITTING

[75] Inventors: Shigehiko Mochizuki; Hiroshi Suzuki, both of Shizuoka, Japan

[73] Assignee: Yazaki Corporation, Tokyo, Japan

[21] Appl. No.: 658,019

[22] Filed: Jun. 4, 1996

Related U.S. Application Data

[63] Continuation of Ser. No. 321,834, Oct. 6, 1994, abandoned.

[30] Foreign Application Priority Data

Oct. 7, 1993 [JP] Japan ..... 5-274753

[51] Int. Cl.[6] ..... H01R 13/44

[52] U.S. Cl. ..... 439/125

[58] Field of Search ..... 439/125, 700, 439/824

[56] References Cited

U.S. PATENT DOCUMENTS

| | | | |
|---|---|---|---|
| 1,538,230 | 5/1925 | Wiederholdt | 439/125 X |
| 5,332,394 | 7/1994 | Frost | 439/125 OR |
| 5,421,736 | 6/1995 | Imanish et al. | 439/125 OR |

FOREIGN PATENT DOCUMENTS

| | | |
|---|---|---|
| A20407986 | 1/1991 | European Pat. Off. . |
| 1908003 | 1/1965 | Germany . |
| 4116395 | 10/1992 | Japan . |

*Primary Examiner*—P. Austin Bradley
*Assistant Examiner*—Daniel Wittels
*Attorney, Agent, or Firm*—Sughrue, Mion, Zinn, Macpeak & Seas

[57] ABSTRACT

A connection fitting for connecting an ignition cable, to which a high voltage current is supplied, with a terminal fitting provided in a recess. The connection fitting is surrounded by an insulator and includes a first fitting engaged with, and fixedly secured to, the insulator, and a second fitting the outer circumferential surface of which is spaced from the inside surface of the insulator and which is engaged with the terminal fitting of a spark plug. The second fitting is movably engaged with the first fitting so as to be capable of being freely displaced relative to the first fitting in a direction perpendicular to the longitudinal axis of the recess. If the axis of the first fitting is shifted at an angle with respect to the axis of the recess and the terminal fitting, the second fitting is displaced relative to the first fitting in a direction perpendicular to the longitudinal axis of the recess. The freedom of movement of the second fitting prevents abrasion of the fittings and of the insulator.

13 Claims, 8 Drawing Sheets

IGNITION CABLE CONNECTION FITTING

This is a Continuation of application Ser. No. 08/321,834 filed Oct. 6, 1994, now abandoned.

BACKGROUND OF THE INVENTION

1. Field of the Invention

The present invention is directed to a connection fitting in an internal combustion engine for connecting a high voltage ignition cable with the terminal fittings of a spark plug or a distributor.

2. Related Art

A conventional spark plug cap for an internal combustion engine comprises a connection fitting and an ignition cable secured together and covered by an insulator. A high voltage current is supplied to the spark plug through the ignition cable.

As shown in FIG. 7, a conventional spark plug cap 100 for a double overhead cam (DOHC) engine is long and slender and connects an ignition cable 101 with an spark plug 3 attached to the bottom portion of a spark plug attaching hole 2.

The ignition cable 101 is connected to a discharge tube 103 by a crimping connector 102 or other connecting means, and a contact spring 104 is interposed between the discharge tube 103 and a connection fitting 105 which engages a terminal 3*a* of the spark plug 3. These parts are covered by a substantially cylindrical insulator 107 molded from insulating rubber or resin so that the parts are insulated and protected.

An end cap 108 made of insulating material is engaged with an end of the insulator 107. An inner circumferential wall of the end cap 108 engages an insulating portion 3*b* of the spark plug 3, and a gap is formed between the outer circumferential surface of the end cap 108 and the inner circumferential wall of the spark plug attaching hole 2 so that the outer circumferential surface of the end cap 108 does not contact the internal circumferential wall of the spark plug attaching hole 2. The plug cap 100 is thus easily inserted into the spark plug attaching hole 2, and the spark plug 3 is enclosed in an airtight fashion for improved insulation.

At an end of the insulator 107 opposite the spark plug 3, a rain cap 109 is provided and engaged in an opening portion of the spark plug attaching hole 2. The rain cap 109 prevents water and dust from entering the spark plug attaching hole 2.

In the plug cap 200 shown in FIG. 8, an ignition cable 201 is directly connected with the spark plug 3 by a crimping connector 203. Otherwise, the plug cap 200 is substantially the same as the plug cap 100 in FIG. 7.

FIG. 9 is a partial cross sectional view showing a connection cap 300 for connecting an ignition cable 301 with a terminal fitting 6 provided at a bottom portion of an ignition cable attaching hole 5 of a distributor 4. The connection cap 300 includes an L-shaped cylindrical connection fitting 302, one end of which is connected with the ignition cable 301 and the other end of which is engaged with the terminal fitting 6, as well as an insulator 303 made of insulating rubber which covers the connection fitting 302. The insulator 303 is engaged with the ignition cable attaching hole 5 so that the terminal fitting 6 is enclosed and insulated in an airtight fashion.

In the aforementioned plug caps 100, 200, the connection fittings 105, 203 are integrally molded with the insulators 107, 207. Locking means 114, 124 respectively provided in the connection fittings 105, 203 are engaged with the terminal fitting 3*a* of the spark plug 3. Further, the rain caps 109, 209 are engaged in the opening of the spark plug attaching hole 2.

Likewise, in the distributor connection cap 300 shown in FIG. 9, the connection fitting 302 is integrally molded with the insulator 303, and the insulator 303 is engaged with the ignition cable attaching hole 5.

In some instances, due to poor manufacturing tolerances, the axes of the insulators 107, 207, 303 are eccentric with respect to the axes of the connection fittings 105,203,302. Also, the axis of the spark plug attaching hole 2 may be eccentric with respect to the axis of the spark plug 3. Likewise, the axis of the ignition cable attaching hole 5 may be eccentric with respect to the axis of the terminal fitting 6.

The connection fittings 105, 203 are press fitted on the terminal fitting 3*a* of the spark plug 3, and the rain caps 109, 209 are press fitted in the spark plug attaching hole 2. Likewise, the connection fitting 302 is press fitted in the terminal fitting 6, and the insulator 303 is press fitted in the ignition cable attaching hole 5.

Accordingly, when the automobile engine vibrates and the spark plugs and distributor are assembled as described above, the connection fittings 105, 203, 303, the spark plug 3, and the terminal fitting 6 are caused to be in frictional contact and, over time, they may become loose or even disengaged.

The rain caps 109, 209 gradually deteriorate due to the heat generated from the engine, and the insulator 303 may be deformed over time, so that the plug caps and the insulator may become disengaged from the spark plug attaching hole 2 and the ignition cable attaching hole 5, respectively. The plug caps 100, 200 and the distributor connection cap 300 may therefore vibrate differently from the engine, increasing frictional abrasion. This is particularly true for the plug cap 100 shown in FIG. 7 since the weight of the plug cap 100 is disproportionately high at the discharge tube 103, i.e., a large inertial force is generated at the discharge tube 103 when the plug cap 100 is vibrated.

Accordingly, an object of the present invention is to prevent the frictional abrasion of connection fittings and terminal fittings which occur in the conventional ignition cable connection fittings described above.

SUMMARY OF THE INVENTION

In order to accomplish the above object, the present invention is directed to an ignition cable connection fitting comprising: a connection fitting, one end of which is connected with an ignition cable and the other end of which is engaged with a terminal fitting provided in a hole; and an insulator covering the connection fitting for insulation, the insulator being inserted into the hole when the connection fitting is engaged with the terminal fitting, wherein the connection fitting includes a first fitting connected with the ignition cable and fixed to the insulator, and also includes a second fitting engaged with the first fitting in such a manner that the second fitting can be freely displaced in a direction perpendicular to an axis of the hole when the connection fitting is inserted into the hole, the second fitting being engaged with the terminal fitting.

Since the first fitting is fixed to the insulator, the first fitting is not displaced relative to the hole when the insulator is inserted in the hole. By way of contrast, the second fitting is freely displaced in a direction perpendicular to the axis of the hole, and engaged with the terminal fitting. The axis of the first fitting and the axis of the terminal fitting can be eccentric. The axis of the connection fitting is aligned with the axis of the terminal fitting for engagement of the two fittings. Engagement of the fittings is therefore attained without the frictional abrasion of the conventional fittings described above.

BRIEF DESCRIPTION OF THE FIGURES

The ignition cable connection fitting of the present invention is explained in detail below with reference to the accompanying drawings, in which.

DETAILED DESCRIPTION OF THE PREFERRED EMBODIMENTS

Figure 1:
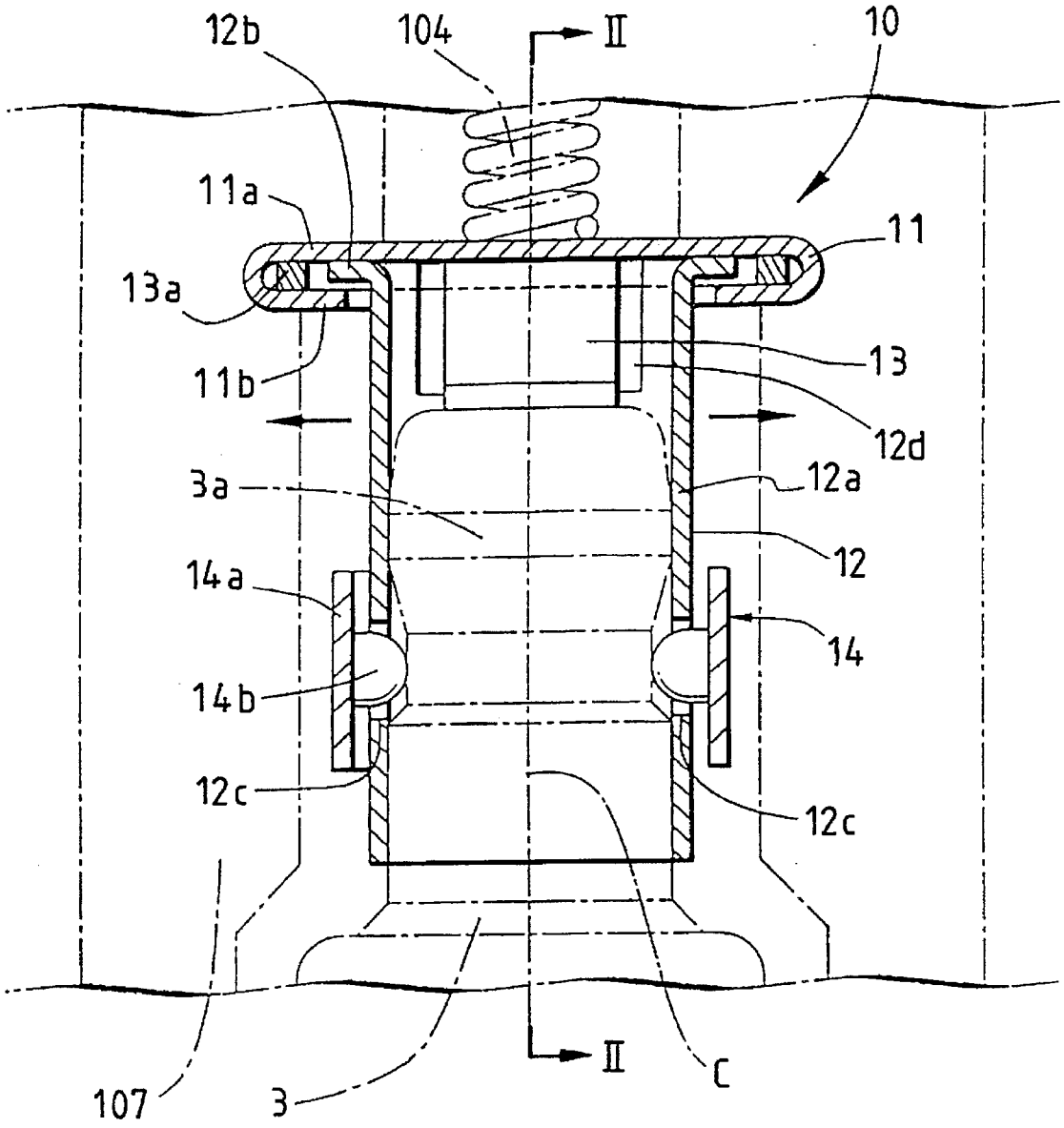
FIG. 1 is an enlarged sectional view of the ignition cable connection fitting of the first embodiment of the present invention.
Figure 2:
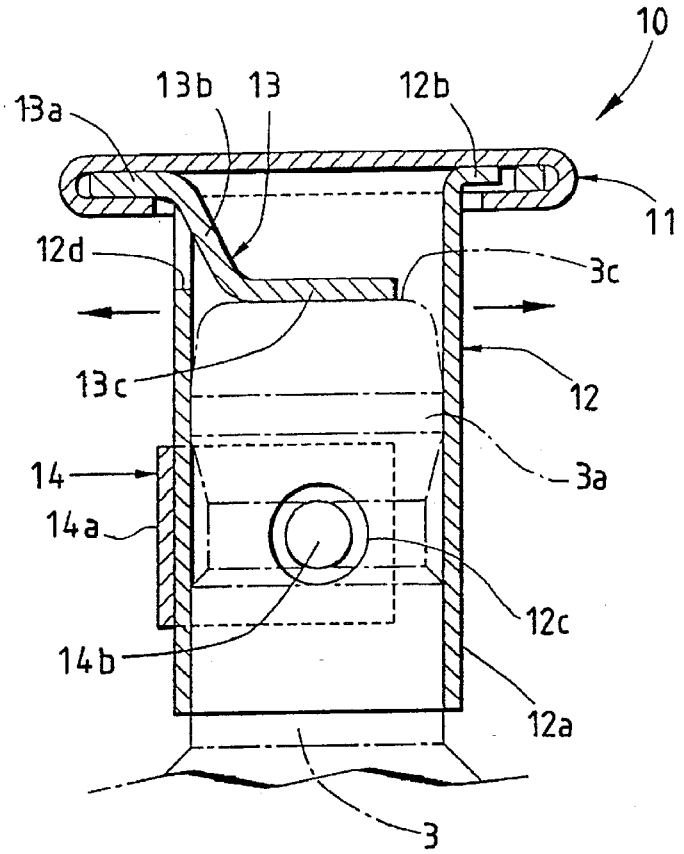
FIG. 2 is a sectional view showing a primary portion of the ignition cable connection fitting of FIG. 1.
Figure 4:
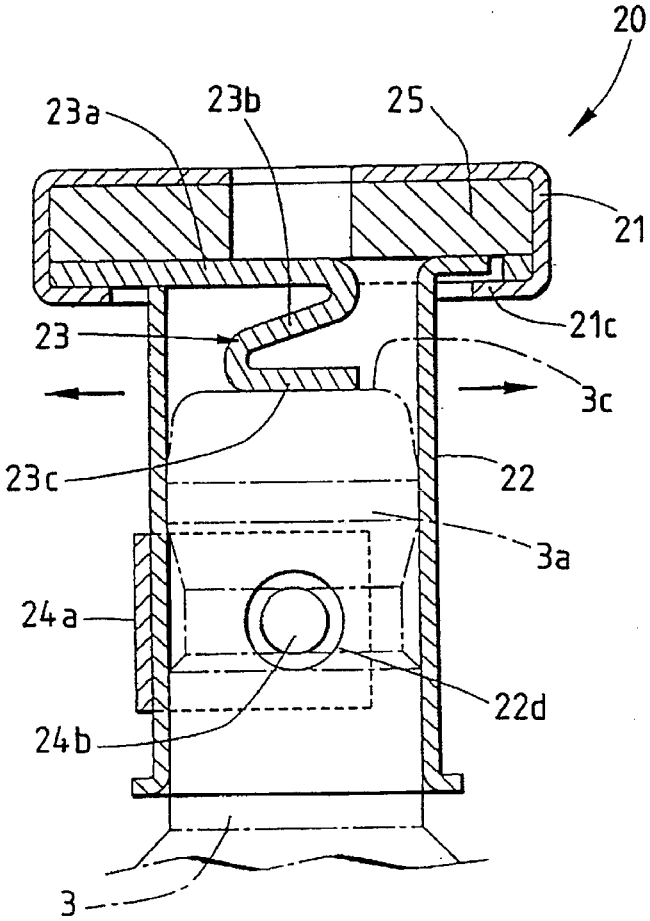
FIG. 4 is a sectional view showing a primary portion of the ignition cable connection fitting of FIG. 3.
Figure 3:
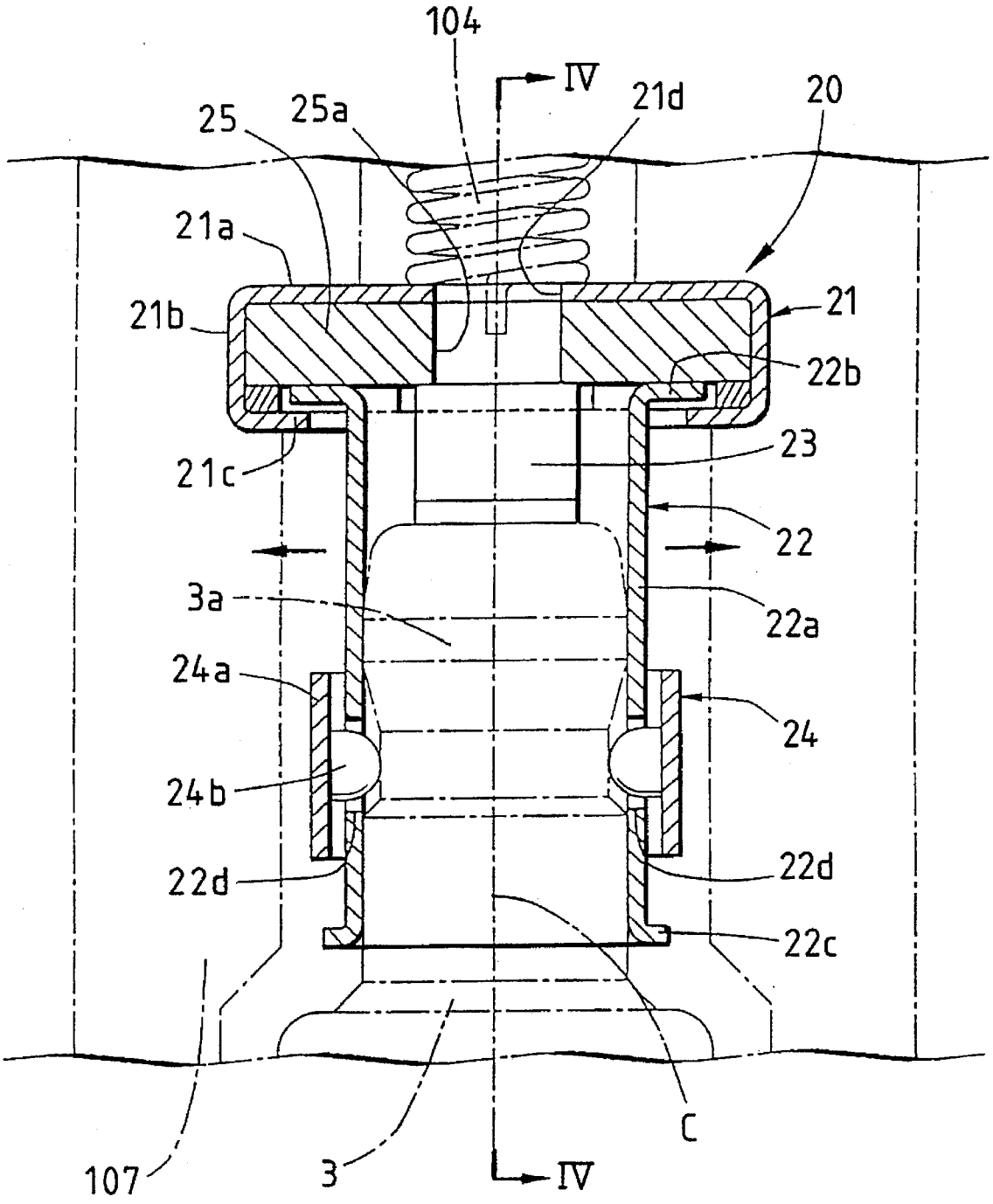
FIG. 3 is an enlarged sectional view of the ignition cable connection fitting of the second embodiment of the present invention.
Figure 5:
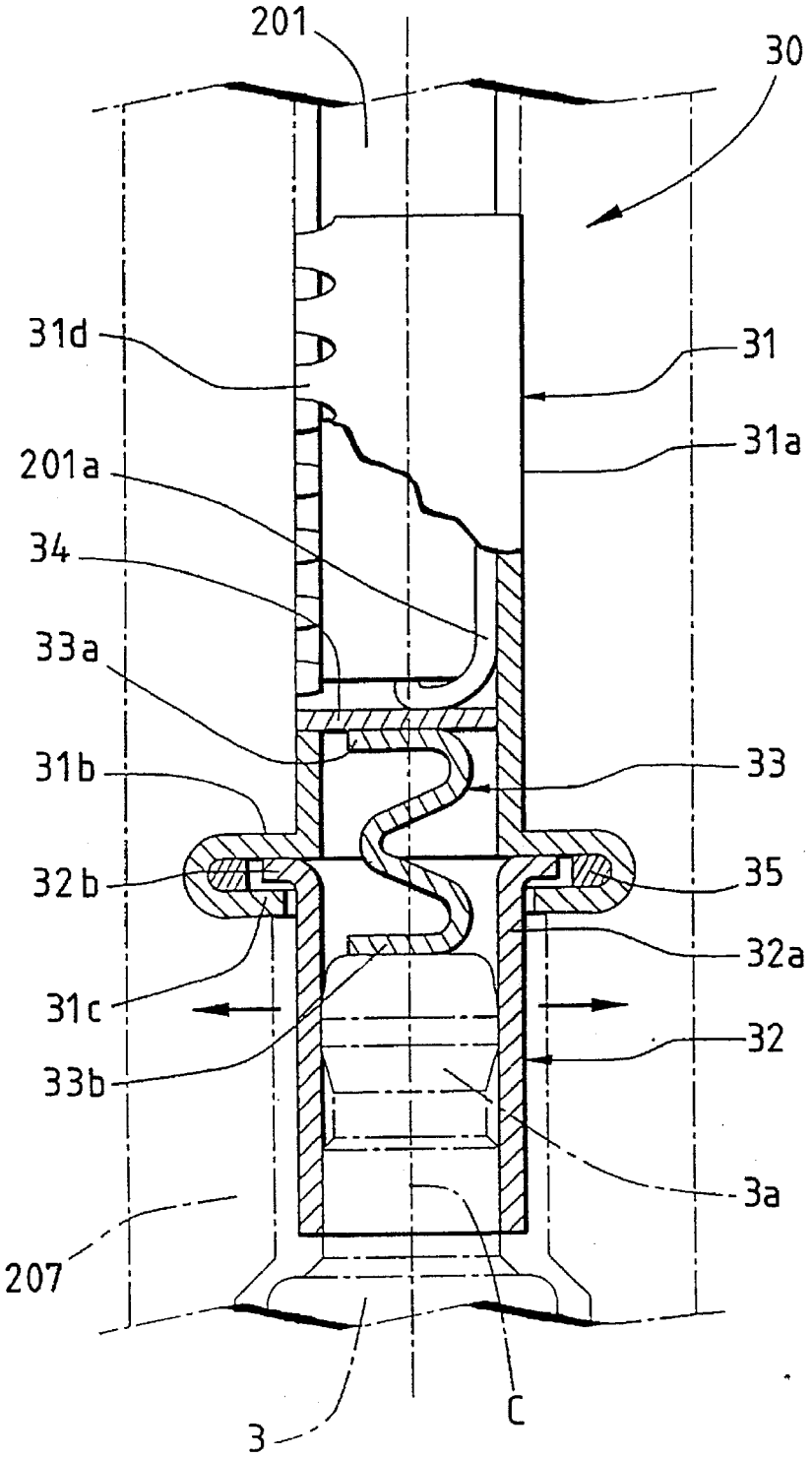
FIG. 5 is an enlarged sectional view of the ignition cable connection fitting of the third embodiment of the present invention.
Figure 6:
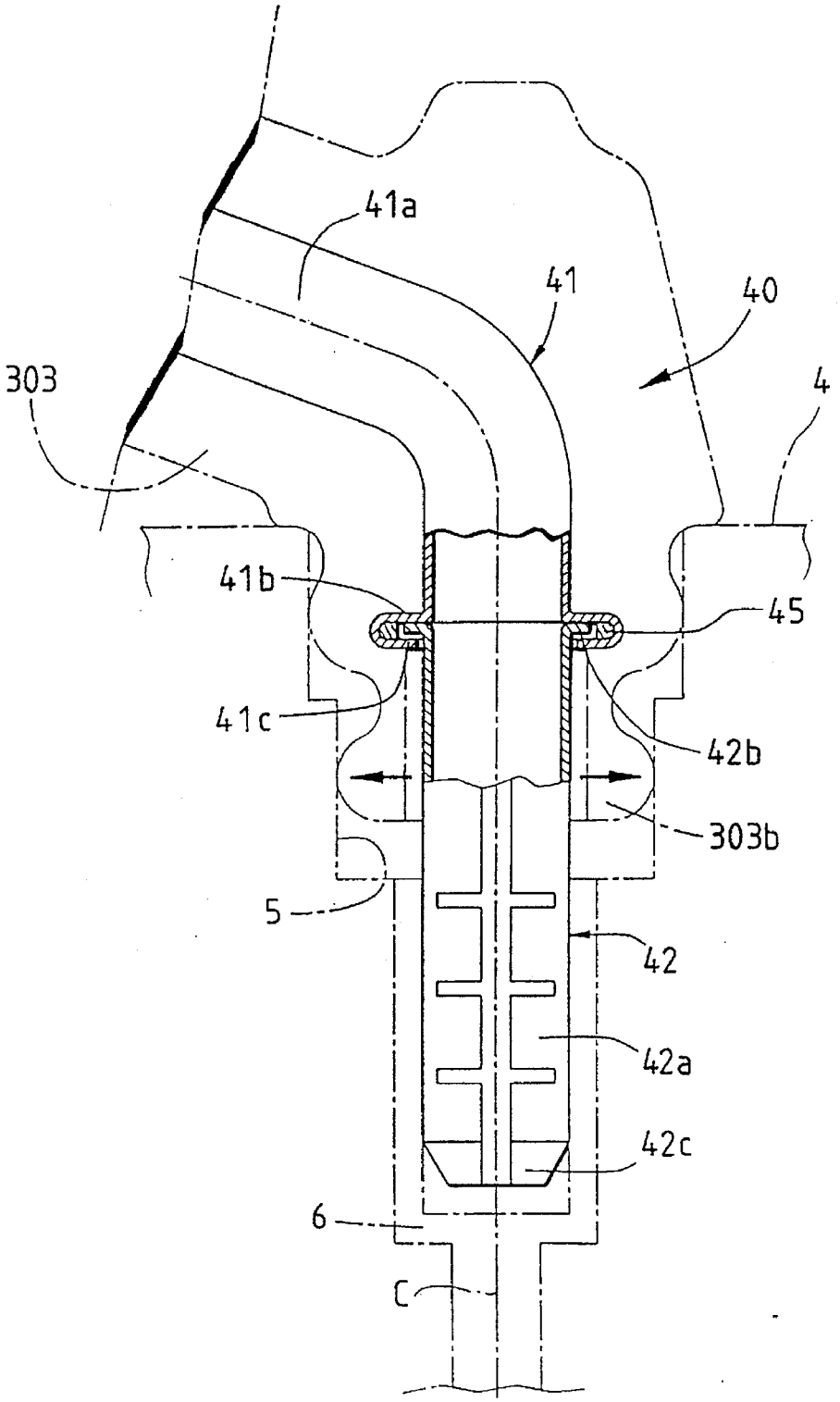
FIG. 6 PRIOR ART
FIG. 6 is an enlarged sectional view of the ignition cable connection fitting of the fourth embodiment of the present invention.

FIG. 1 is an enlarged sectional view of the ignition cable connection fitting of the first embodiment. FIG. 2 is a sectional view taken along line II—II in FIG. 1 showing a primary portion of the ignition cable connection fitting of FIG. 1. FIG. 3 is an enlarged sectional view of the ignition cable connection fitting of the second embodiment. FIG. 4 is a sectional view taken along line IV—IV showing a primary portion of the ignition cable connection fitting of FIG. 3. FIG. 5 is an enlarged sectional view of the ignition cable connection fitting of the third embodiment. FIG. 6 is an enlarged sectional view of the ignition cable connection fitting of the fourth embodiment.

Figure 7:
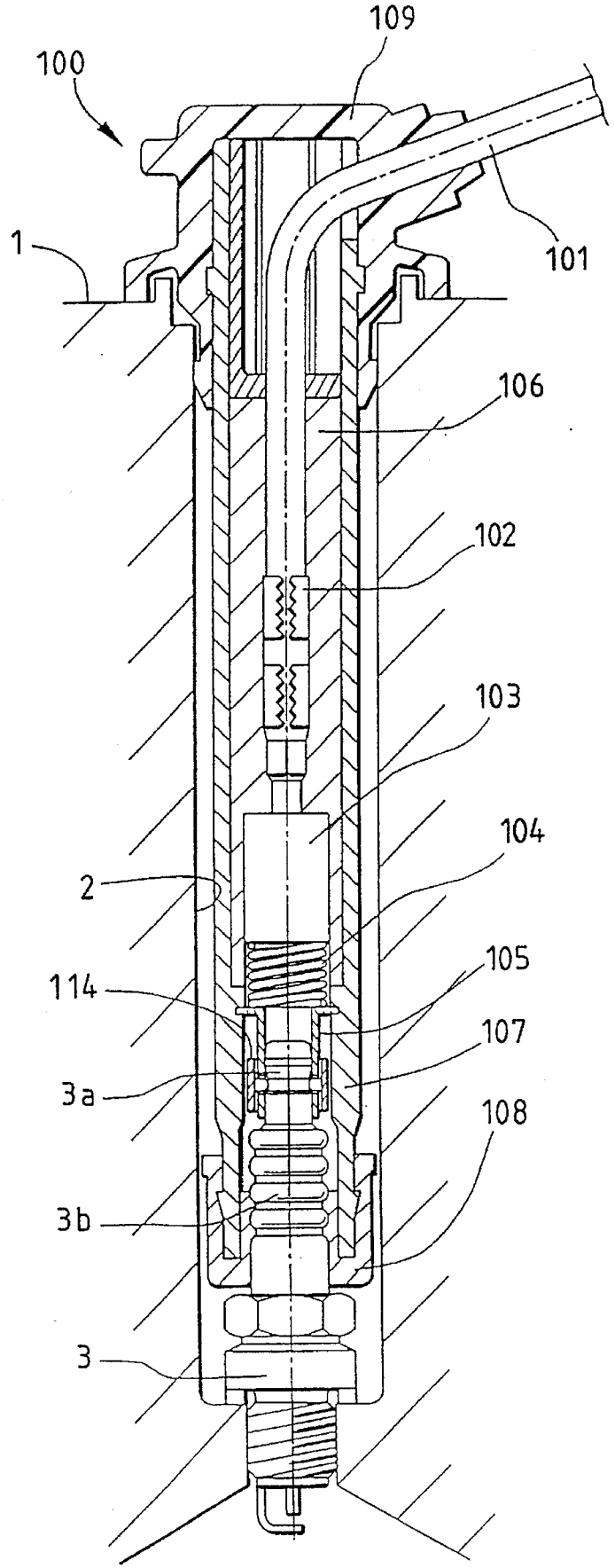
FIG. 7 PRIOR ART
FIG. 7 is a sectional view of the conventional plug cap.

The ignition cable connection fitting of the first embodiment of the present invention is different from the conventional connection fitting 105 of the plug cap 100 shown in FIG. 7 in the following respects.

As shown in FIGS. 1 and 2, the ignition cable connection fitting 10 includes a first fitting 11, a second fitting 12, one end of which is loosely engaged with the first fitting 11, a contact member 13 fixed to the first fitting 11, and a locking means 14 attached to the second fitting 12.

The first fitting 11 includes a disk-shaped portion 11*a* which positions and engages a contact spring 104, and a bent portion 11*b* formed by bending a flange provided on the outer circumference of the disk-shaped portion 11*a* inwardly in the radial direction. The outer circumference of the contact member 13 is fixedly secured between the disk-shaped portion 11*a* and the bent portion 11*b*. The first fitting 11 is fixed in position by integral engagement with an insulator 107.

The second fitting 12 includes a cylindrical portion 12*a*, flange portion 12*b* provided at an end of the cylindrical portion 12*a* adjacent the first fitting 11 and extending outwardly in the radial direction, a pair of through holes 12*c* formed in the cylindrical portion 12*a*, and a cutout portion 12*d* through which the contact member 13 protrudes. The flange portion 12*b* is loosely secured between the disk-shaped portion 11*a* and the flange or bent portion 11*b* of the first fitting 11. The insulator 107 surrounds the circumference of the second fitting 12 with a gap formed therebetween. The second fitting 12 is loosely engaged with the first fitting 11 so that the second fitting 12 is freely displaced with respect to the first fitting 11 in a direction perpendicular to the axis C of the insulator 107, as indicated by the arrows in FIG. 1.

The contact member 13 (FIG. 2) is formed from a disk-shaped sheet, and has a strip-shaped contact piece resiliently contacting an end surface 3*c* of the spark plug 3. The contact member 13 includes a disk-shaped portion 13*a*, a contact portion 13*c* contacting the end surface 3*c* of the spark plug 3, and a diagonally extending portion 13*b* connecting the contact portion 13*c* with the disk-shaped portion 13*a*. The outer circumference of the disk-shaped portion 13*a* is held and fixed by the bent portion 11*b* of the first fitting 11. The disk-shaped portion 13*a* is thicker than the flange portion 12*b* of the second fitting 12, and is shaped so as not to interfere with the connection between the first and second fittings 11, 12, respectively.

The locking means 14 engages the connection fitting 10 with the spark plug 3 so that the connection fitting 10 is not easily disconnected from the spark plug 3. The locking means 14 includes a C-shaped spring 14*a* formed from a strip-shaped sheet and a pair of opposing engaging components 14*b* attached to the ends of the spring 14*a*. The engaging components 14*b* protrude inwardly from the through-holes 12*c* formed in the second fitting 12 and are engaged with a constricted portion of the terminal fitting 3*a* so that the second fitting 12 is not disconnected from the spark plug 3.

In the above described construction, when the axis C of the insulator 107 does not coincide with the axis of the spark plug 3, only the second fitting 12 is displaced to compensate for the non-alignment. Accordingly, there is no problem with respect to abrasion caused by vibration of the engine.

Further, since the second fitting 12 can be displaced with respect to the first fitting 11, even if the rain cap 109 gradually deteriorates and becomes only loosely engaged with the inner circumference of the spark plug attaching hole 2, the connection between the spark plug 3 and the connection fitting 10 is maintained, and the connection fitting 10 is not vibrated differently from the engine.

An ignition cable connection fitting of the second embodiment of the present invention is explained below with respect to FIGS. 3 and 4. The first fitting 21 of the second embodiment is different from the first fitting 11 described above.

A through-hole 21*d* is provided in a disk-shaped portion 21*a* of the first fitting 21 for connecting the contact spring 104. A flange 21*b* provided on the outer circumference of the disk-shaped portion 21*a* is longer than the flange of the first fitting 11 in the first embodiment. A disk-shaped spacer 25 made of a thick plate having a through-hole 25*a* is inserted inside of the flange 21*b* of the first fitting 21. An end of the flange 21*b* is bent inwardly in the radial direction so that the bent portion opposes the spacer 25 with a gap formed therebetween.

In the second fitting 22 of the ignition cable connection fitting 20 of the second embodiment, a flange 22*c* extending outwardly in the radial direction is provided at an opening in the second fitting 22 on the spark plug 3 side. Otherwise, the construction of the second fitting 22 is the same as that of the second fitting 12 of the ignition cable connection fitting 10 of the first embodiment. A locking means 24 is also provided in the same manner as the locking means 14 of the first embodiment.

The flange 22*b* provided at a the end of the second fitting 22 on the first fitting 21 side is engaged in the gap between the portion 21*c* of the flange 21*b* of the first fitting 21 and the spacer 25. The insulator 107 surrounds the second fitting 22 with a gap formed therebetween.

The second fitting 22 is freely displaced with respect to the first fitting 21 in a direction perpendicular to the axis C of the insulator 107 as,indicated by the arrows in FIG. 3. A contact member 23 is provided between the second fitting 22 and the first fitting 21 in the same manner as described above with respect to the first embodiment, and the first and second fittings 21, 22 are movably engaged so as not to cause frictional abrasion.

As shown in FIG. 4, the contact member 23 of the ignition cable connection fitting 20 of the second embodiment is formed by bending a strip into a Z-shape in side view. A base portion 23*a* of the contact member 23 is held between the spacer 25 and the bent portion 21*c* of the end of the flange of the first fitting 21. The end 23*c* is biased to contact the end surface 3*c* of the spark plug 3.

An ignition cable connection fitting of the third embodiment of the present invention is described below with respect to FIG. 5.

The connection fitting 30 in FIG. 5 includes a first fitting 31 for directly securing the ignition cable 201, and a second fitting 32 engaged with the spark plug 3.

The first fitting 31 includes a cylindrical portion 31*a* enclosing the ignition cable 201 and having a plurality of claws 31*d* for securing the ignition cable 201 relative to the first fitting 31, a stopper wall 34 for closing the cylindrical portion 31*a*, a conductor 201*a* connected to the ignition cable 201 and biased against the stopper wall 34, and a flange 31*b* provided at the end of the first fitting 31 adjacent the spark plug 3. The flange 31*b* curves outwardly in a radial direction, then downwardly in a longitudinal direction, and then inwardly to form a bent portion 31*c* in parallel with the flange 31*b* and with a gap therebetween.

The second fitting 32 includes a cylindrical portion 32*a* engaging the terminal fitting 3*a* of the spark plug 3, and a flange portion 32*b* provided at an end of the cylindrical portion 32*a* adjacent the first fitting 31. The flange portion 32*b* extends outwardly in a radial direction and is movingly secured between the flange 31*b* and the bent portion 31*c*. A spacer 35 is also interposed between the flange 31*b* and the bent portion 31*c* so as not to interfere with the movable engagement of the flange portion 32*b*. The spacer 35 is thicker than the flange portion 32*b* of the second fitting 32. The insulator 207 surrounds the second fitting 32 with a gap therebetween, as shown in FIG. 5.

The second fitting 32 is freely displaced in a direction perpendicular to the axis C of the insulator 207, as indicated by the arrows in FIG. 5.

A contact member 33 is provided inside the cylindrical portion 31*a* of the first fitting 31. The contact member 33 is resiliently biased to abut against an end surface of the spark plug 3 and is welded to a surface of the stopper wall 34 on the spark plug side of the stopper wall 34.

The contact member 33 is made of a strip of conducting material and bent approximately into a wave-shape so that it exhibits resiliency in the longitudinal direction. The lower end 33*b* of the contact member 33 is biased against the top of the spark plug 3.

Figure 8:
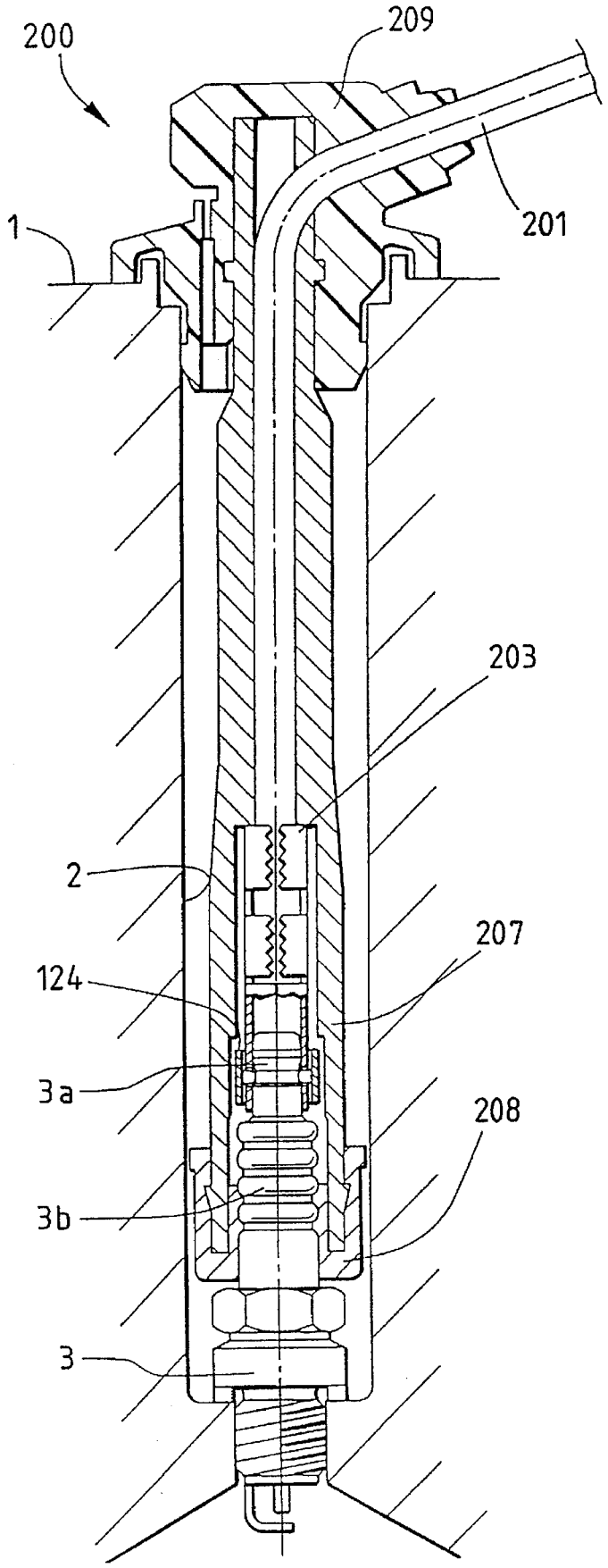
FIG. 8 PRIOR ART
FIG. 8 is a sectional view of another conventional plug cap.

In the connection fitting 30 of the third embodiment, the second fitting 32 is freely displaced in a direction perpendicular to the axis C of the insulator 207 even though the ignition cable is directly connected with the ignition plug (see FIG. 8).

An ignition cable connection fitting of the fourth embodiment of the present invention is described below with reference to FIG. 6.

Figure 9:
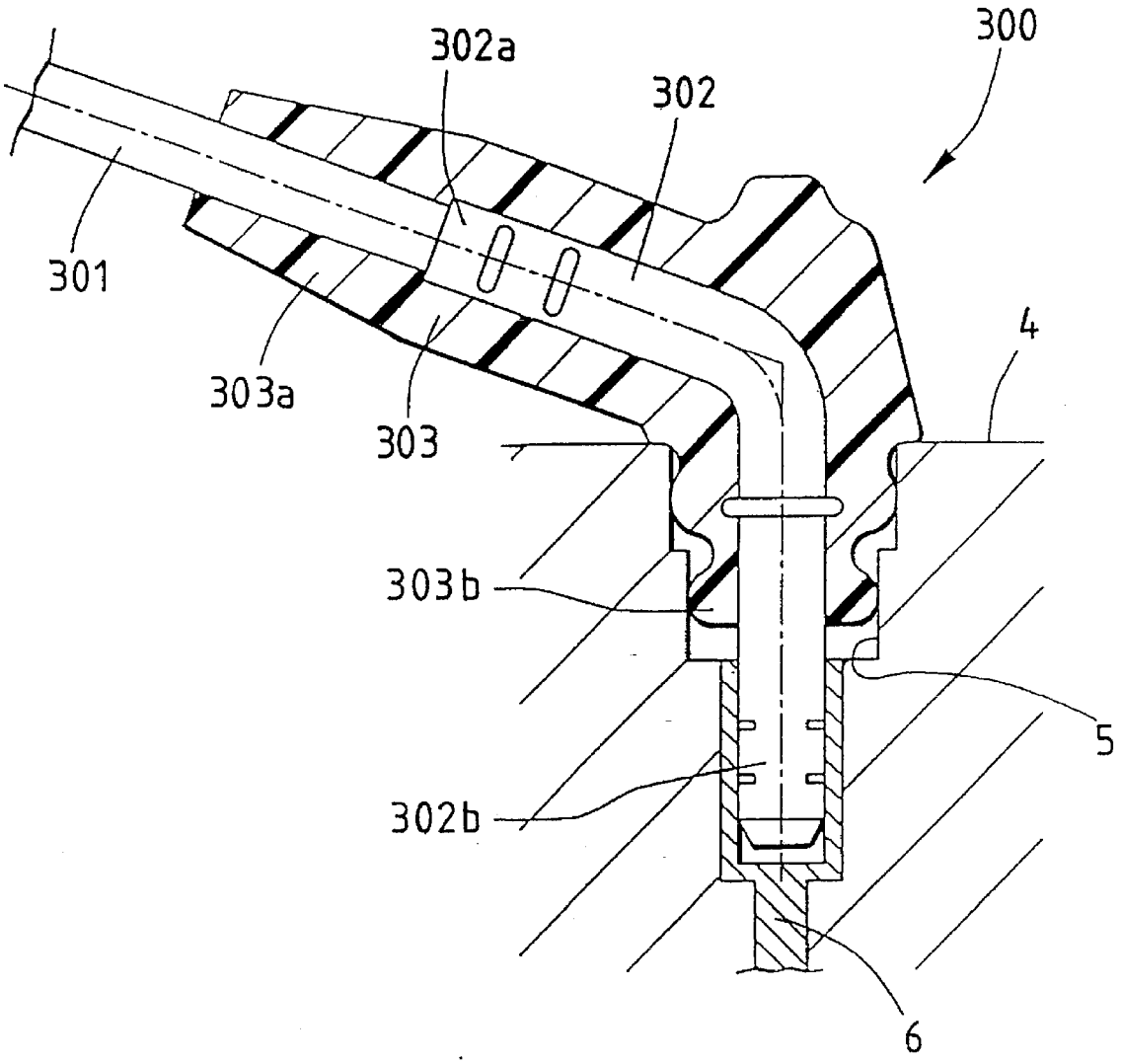
FIG. 9 PRIOR ART
FIG. 9 is a sectional view of the conventional distributor cap.

The connection fitting 40 of the fourth embodiment is constructed differently from the conventional connection fitting 302 shown in FIG. 9. The connection fitting 40 of the fourth embodiment includes a first fitting 41 and second fitting 42.

The first fitting 41 includes an L-shaped cylindrical portion 41*a* to which the ignition cable is fixed, and a flange 41*b* at the other end of the cylindrical portion 41*a* on the spark plug 3 side. The flange 41*b* extends outwardly in the radial direction, then downwardly in the longitudinal direction, and then inwardly in the radial direction to form a bent portion 41*c* with a gap formed therebetween.

The second fitting 42 includes a cylindrical portion 42*a* engaging the terminal fitting 6, and a flange 42*b* provided at an end of the cylindrical portion 42*a* on the first fitting 41 side. The flange 42*b* extends outwardly in the radial direction and is engaged between the flange 41*b* and the bent portion 41*c* of the first fitting 41. A spacer 45 is also interposed between the flange 41*b* and the bent portion 41*c*. An insulator 303 surrounds the second fitting 42 with a gap formed therebetween.

The second fitting 42 is freely displaced in a direction perpendicular to the axis C of the first fitting 41, as shown by the arrows in FIG. 6.

In the connection fitting 40 of the fourth embodiment described above, even if the axis of first fitting 41 of the connection fitting 40 and the axis of the terminal fitting 6 are eccentric, there is no abrasion caused by friction between the second fitting 42 and the insulator 303 since the first and second fittings 41, 42 are movably engaged.

The present invention is intended to provide an ignition cable connection fitting comprising a connection fitting, one end of which is connected with an ignition cable and the other end of which is engaged with a terminal fitting provided in a hole, and an insulator covering the connection fitting for insulation. The insulator is inserted into the hole and the connection fitting is engaged with the terminal fitting, wherein the connection fitting includes a first fitting connected with the ignition cable and fixed to the insulator, and a second fitting engaged with the first fitting so that the second fitting is freely displaced in a direction perpendicular to an axis of the hole and wherein a gap of predetermined width is formed between the second fitting and the inside surface of the insulator.

The first fitting is integrally formed with the insulator which is fixed with respect to the hole through the rain cover and the end cap. By way of contrast, the second fitting can be freely displaced in a direction perpendicular to the axis of the hole, so that the second fitting remains engaged with the terminal fitting when the axis of the insulator and the first fitting are eccentric with respect to the axis of the terminal fitting and the hole.

Vibrations of the engine which cause the axis of the connection fitting and the terminal fitting of the conventional cable connection fitting to become eccentric, and which normally cause abrasion of the fittings and the insulator, are not a problem in the instant invention since the positionally fixed first fitting is movably connected to the second (connection) fitting. Since the connection fitting is free to move in a direction substantially perpendicular to the axis of the hole, engine vibrations do not cause abrasion of the fittings or the insulator.

What is claimed is:

1. An ignition cable connection fitting comprising:

a connection fitting, one end of which is connected with an ignition cable and the opposite end of which is engaged with a terminal fitting provided in a recess; and an insulator surrounding said connection fitting for insulation, wherein said connection fitting comprises first and second fittings, and wherein said insulator is inserted in the recess for connecting the second fitting with the terminal fitting, the first fitting being fixedly secured inside said insulator and connected with the ignition cable, the second fitting being movably engaged with the first fitting so the second fitting can be freely displaced relative to the first fitting in a direction substantially perpendicular to a longitudinal axis of the recess when said insulator is secured in the recess.

2. The ignition cable connection fitting as recited in claim 1, wherein the first fitting is integrally formed with said insulator, and wherein a gap of predetermined width is formed between an outer circumferential surface of the second fitting and an inner circumferential surface of the insulator to facilitate movement of the second fitting relative to the first fitting.

3. The ignition cable connection fitting as recited in claim 1, wherein the first fitting comprises a disk-shaped portion having circumferential edges, the circumferential edges being bent in a radial direction to form a gap between the circumferential edges and an opposing surface of the substantially flat disk-shaped portion, and wherein the second fitting is provided with a flange received in the gap.

4. The ignition cable connection fitting as recited in claim 3, wherein a thickness of the flange is smaller than a thickness of the gap so that the second fitting is movably engaged with the first fitting, and so that the second fitting is free to move relative to the first fitting in the direction substantially perpendicular to the longitudinal axis of the hole.

5. The ignition cable connection fitting as recited in claim 1, further comprising a contact member secured to, and protruding from, the first fitting for contacting the terminal fitting.

6. The ignition cable connection fitting as recited in claim 5, wherein said contact member comprises a resilient member.

7. The ignition cable connection fitting as recited in claim 3, further comprising:

a contact member secured within, and protruding from, the gap for contacting the terminal fitting; and a spacer inserted in the gap and having a thickness greater than a thickness of the flange and greater than a thickness of a portion of the contact member secured within the gap.

8. The ignition cable connection fitting as recited in claim 7, wherein the spacer is positioned in the gap between the contact member and the opposing surface of the substantially flat disk-shaped portion, and between the flange and the opposing surface of the substantially flat disk-shaped portion.

9. The ignition cable connection fitting as recited in claim 1, wherein the first fitting is directly contacted by an end of the ignition cable.

10. The ignition cable connection fitting as recited in claim 9, wherein the first fitting comprises a substantially cylindrical hollow portion in which the end of the ignition cable is inserted, and a stopper wall inserted in the hollow portion to separate the ignition cable from the terminal fitting, wherein the end of the ignition cable is in direct electrical contact with the stopper wall, and wherein a contact is secured to, and protrudes from, the stopper wall to contact the terminal fitting.

11. The ignition cable connection fitting as recited in claim 1, wherein a spring is interposed between the first fitting and the ignition cable for supplying a high voltage to the terminal fitting.

12. An ignition cable connection fitting for connecting a high voltage ignition cable with a male terminal fitting of a spark plug, the terminal fitting being provided in a recess, said fitting comprising:

a connection fitting, one end of which is connected with the ignition cable and the opposite end of which is engaged with the terminal fitting provided in the recess; and an insulator surrounding said connection fitting for insulation, wherein said connection fitting comprises first and second fittings, and wherein said insulator is inserted in the recess for connecting the second fitting with the terminal fitting, the first fitting being fixedly secured inside said insulator and connected with the ignition cable, the second fitting being movably engaged with the first fitting so the second fitting can be freely displaced relative to the first fitting in a direction substantially perpendicular to a longitudinal axis of the recess when said insulator is secured in the recess.

13. An ignition cable connection fitting for connecting a high voltage ignition cable with a female terminal fitting of a distributor, the terminal fitting being provided in a recess, said fitting comprising:

a connection fitting, one end of which is connected with the ignition cable and the opposite end of which is engaged with the terminal fitting provided in the recess; and an insulator surrounding said connection fitting for insulation, wherein said connection fitting comprises first and second fittings, and wherein said insulator is inserted in the recess for connecting the second fitting with the terminal fitting, the first fitting being fixedly secured inside said insulator and connected with the ignition cable, the second fitting being movably engaged with the first fitting so the second fitting can be freely displaced relative to the first fitting in a direction substantially perpendicular to a longitudinal axis of the recess when said insulator is secured in the recess.

* * * * *